US007255062B1

(12) United States Patent
Higman

(10) Patent No.: US 7,255,062 B1
(45) Date of Patent: Aug. 14, 2007

(54) PSEUDO SURFACE MICROWAVE PRODUCED PLASMA SHIELDING SYSTEM

(76) Inventor: Kumiko I. Higman, 20071 Cairo Hollow Rd., Athens, AL (US) 35614

( * ) Notice: Subject to any disclaimer, the term of this patent is extended or adjusted under 35 U.S.C. 154(b) by 150 days.

(21) Appl. No.: 11/124,682

(22) Filed: May 9, 2005

Related U.S. Application Data

(60) Provisional application No. 60/569,091, filed on May 7, 2004.

(51) Int. Cl.
*H05H 1/02* (2006.01)

(52) U.S. Cl. ..... 118/723 MW; 118/723 AN; 315/111.51

(58) Field of Classification Search ..... 118/723 R, 118/723 MW, 723 I, 723 MA, 723 AN; 315/111.21, 315/111.51
See application file for complete search history.

(56) References Cited

U.S. PATENT DOCUMENTS 4,064,852 A * 12/1977 Fulenwider, Jr. ..... 123/25 B
4,507,588 A * 3/1985 Asmussen et al. ..... 315/39
4,745,337 A * 5/1988 Pichot et al. ..... 315/111.41
5,304,277 A * 4/1994 Ohara et al. ..... 156/345.42
5,797,563 A * 8/1998 Blackburn et al. ..... 244/130
6,054,016 A * 4/2000 Tuda et al. ..... 156/345.42
6,247,671 B1 * 6/2001 Saeks et al. ..... 244/205
6,667,577 B2 * 12/2003 Shannon et al. ..... 315/111.21

OTHER PUBLICATIONS

H. Conrads et al, "Plasma Generation and Plasma Sources", Plasma SOurces Sci. Technol., Sep. 27, 2000, p. 441-454, vol. 9.*

M. Moisan et al, "Plasma Sources based on the Propagation of Electromagnetic Surface Waves", J. Phys. D: Appl. Phys., Jan. 28, 1991, pp. 1025-1048, vol. 24.*

Roth et al, "Boundary Layer Flow Control with a one Atmosphere Uniform Glow Discharge Surface Plasma", Jan. 12-15, 1998, AIAA 98-0328, 36th Aerospace Sciences Meeting & Exhibit, Reno NV.*

Krail et al, "Principles of Plasma Physics", 1986, pp. 173-177, Sanfrancisco Press. Inc. ISBN 0-911302-58-1.*

(Continued)

*Primary Examiner*—David Vu
(74) *Attorney, Agent, or Firm*—Mark Clodfelter

(57) ABSTRACT

A pseudo surface microwave produced plasma shielding system is a simple device that creates a prescribed plasma environment with a prescribed plasma density gradient, and protects an object surrounded by this environment as a shield. Pseudo surface microwaves interacting with an artificial intelligence equipped on board are used to create and to adjust this plasma environment for a particular application. This plasma environment provides potential capabilities of military applications of the plasma in the system. Examples of military applications include a stealth system from RADAR and SONAR, a protection system from WMD, and a weapon system to generate and launch plasmoids as a plasma gun. The scope of this invention extends to commercial applications of this plasma shielding system as a conditioned and controlled flow field, for example, a boundary layer and turbulence control system, and a lift control system to improve flight performance and flight economy of aircrafts. It further extends to develop a concept of a new type of engine using this plasma shielding system as a heating method alternative to the conventional combustion method that uses petroleum based fuel in the combustion chamber of an engine.

19 Claims, 11 Drawing Sheets

OTHER PUBLICATIONS

Meng, "Wall ayer Microturbulence Phenomenology and a Markov Probability Model for Active Electromagnetic Control of Turbulence Boundary Layers in an Electrically Conducting Medium", Jun. 1, 1995, Abstract, pp. 1-2.*

Leonov, "Plasma Influence on Characteristics of Aerodynamic Friction and Separation Lines Location", Sep. 2000, Abstract, pp. 1.*

* cited by examiner

Side View

Front View

Front View

PSEUDO SURFACE MICROWAVE PRODUCED PLASMA SHIELDING SYSTEM

Applicant claims the benefit of provisional application Ser. No. 60/569,091, filed May 7, 2004.

FIELD OF THE INVENTION

The present invention relates to applications of plasma to a defense system, specifically, a pseudo surface microwaves produced plasma shielding system. This plasma shielding system can be used to protect an object as a part of a defense system, for example, functioning as a stealth system from RADAR and SONAR, a protection system from weapons of mass destruction (WMD), and a weapon system to generate and launch plasmoids as a plasma gun. This plasma shielding system can also be used to condition and control a flow field in order to improve flight performance and flight economy of aircrafts, for example, as a boundary layer and turbulence control system, and a lift control system. This plasma shielding system can further be used as a heating method of a propellant that is alternative to the conventional combustion method using petroleum based fuel in a combustion chamber of an engine. This present invention also relates to application of a computer control system with A.I.

BACKGROUND OF THE INVENTION

There are some unique natures that a plasma exhibits. The dispersion relation of an electromagnetic wave propagating in a plasma indicates that the index of refraction ñ of a plasma is less than unity. This means that a plasma is a dispersive medium. If we make a convex plasma lens with the density profile of its maximum at the center of the plasma, the light going through this plasma convex lens will diverge. Some electromagnetic waves such as transverse electric and magnetic (TEM) waves have particular resonant frequencies in propagating through a plasma with a particular density. When this happens, the electromagnetic wave is absorbed into the plasma and disappears by giving off its wave energy to the plasma particles.

Knowing these natures of plasma, if we can design the plasma environment to surround an object in a way that an incoming electromagnetic wave propagates through the plasma but diverges away from the surface of the object or is absorbed in the plasma before it reaches to the surface of the object, then the system with this plasma environment will not be detected by RADAR. This can be done by creating a plasma environment with the appropriate plasma density gradient providing a sufficient deflection of the wave path and with the appropriate plasma density that creates a resonance condition of the incoming wave.

Many different methods to produce plasmas were studied in the past and some methods using microwaves to produce and heat a plasma are invented (Pichot et al. U.S. Pat. No. 4,745,337, Ohara et al. U.S. Pat. No. 5,304,277, Tuda et al. U.S. Pat. No. 6,054,016). These methods vary from a dc discharge method to a laser or an electron beam induced method (H. Conrads and M. Schmidt, "Plasma Generation and Plasma Sources", Plasma Sources Science Technology 9, 2000, 441-454). Among them, Microwave and Radio Frequency (RF) discharge methods, or High Frequency (HF) discharge methods have extensively been studied. These methods have merits compared to other methods in terms of the quality of plasmas produced, long duration of the device, low cost, simplicity, efficiency and reliability. A high density plasma is obtainable even at atmospheric pressure using these methods and the ion temperature can be controlled over a wide range by applying additional dc fields or RF bias voltage (H. Conrads and M. Schmidt, "Plasma Generation and Plasma Sources", Plasma Sources Science Technology 9, 2000, 441-454). The life time of these devices is long due to their electrodeless structure. Recently, a method to use electromagnetic surface waves such as surfatrons to produce and sustain plasmas is attaining attention in many areas. Merits using this type of waves to produce and sustain plasmas were addressed and discussed. (H. Conrads and M. Schmidt, "Plasma Generation and Plasma Sources", Plasma Sources Science Technology 9, 2000, 441-454, M. Moisan and Z Zakrzewski, "Plasma Sources based on the Propagation of Electromagnetic Surface Waves", J. Phys. D: Appl. Phys. 24, 1991 1025-1048, Milan Siry, Tibor Terebessy and Masashi Kando, "Study of Surface Wave Propagation along the Dielectric Side all in Large-Area Microwave Discharge", sources unknown)

In the method to produce plasmas using surfatrons, it is common to launch a surface wave along a dielectric tube and to confine a plasma. (H. Conrads and M. Schmidt, "Plasma Generation and Plasma Sources", Plasma Sources Science Technology 9, 2000, 441-454, M. Moisan and Z Zakrzewski, "Plasma Sources based on the Propagation of Electromagnetic Surface Waves", J. Phys. D: Appl. Phys. 24, 1991 1025-1048, Milan Siry, Tibor Terebessy and Masashi Kando, "Study of Surface Wave Propagation along the Dielectric Side all in Large-Area Microwave Discharge", sources unknown) However, it is possible to launch this type of wave into a region where the air is partially and weakly ionized since an electromagnetic wave has a nature to push plasma particles away from it due to its radiation pressure and due to the effect of the ponderomotive force, making a similar condition to the vacuum-plasma boundary in its traveling path. (Nicholas A. Krall and Alvin W. Trivelpiece, "Principles of Plasma Physics", 1986, San Francisco Press. Inc. ISBN 0-911302-58-1) It is also possible that this pseudo surface electromagnetic wave produces a plasma in an unconfined region and at the same time, it sustains the plasma configuration generated there by obtaining a steady state condition. The use of microwaves to launch as this type of surface waves seems to be promising for this purpose.

If an object is placed in a preconditioned partially and weakly ionized plasma environment and this pseudo surface microwave is launched along the surface of the object but in the vicinity of the surface, a plasma environment with a plasma density gradient is created to surround the object. If this plasma density profile has an appropriate gradient to deflect an incoming electromagnetic wave from the object, this plasma environment can function as a shield to protect the object from being detected by a device that uses reflection of a wave, such as RADAR.

In the prior art, this kind of defense system does not exist. Therefore, I propose a pseudo surface microwave produced plasma shielding system as a defense system, which is a simple electrodeless device that creates a prescribed plasma environment with a prescribed plasma density gradient, and protects an object surrounded by this environment as a shield. This shielding system is not only capable to shield out various electromagnetic waves with various frequencies but it is also capable to shield out an ordinary sound wave by changing the mechanism of wave propagation from a sound wave to an ion acoustic wave in an electromagnetic field environment. It can also protect the object from harmful effects from weapons of mass destruction (WMD) since it can shield out electromagnetic pulses (EMP) created from nuclear explosions against nuclear weapons, instantly change chemical compositions of chemical agents by dissociation and ionization, and instantly kill any kind of virus or bacteria and sanitize the environment against biological weapons. This shielding system also has an extended capability to function as a weapon system to launch plasmiods as a plasma gun as a part of a defense system.

It can further extend its capability to function as a flow field control system to in order to improve flight performance and flight economy of aircrafts, for example, as a boundary layer and turbulence control system, and a lift control system of an airfoil. The use of a plasma flow to control a boundary layer to reduce a drag and noise was studied in the past. (J. R. Roth, D. M. Sherman, S. P. Wilkinson, "Boundary Layer Flow Control with a One Atmospheric Uniform Glow Discharge Surface Plasma", AIAA 98-0328, 36$^{th}$ Aerospace Sciences Meeting & Exhibit, Jan. 12-15, 1998, Reno, Nev., J. C. Meng, "Wall Layer Microturbulence Phenomenology and a Markov Probability Model for Active Electromagnetic Control of Turbulent Boundary Layers in an Electrically Conducting Medium", A745692, Jun. 1, 1995, S. Leonov, "Plasma Influence on Characteristics of Aerodynamic Friction and Separation Lines Location", A517483, September, 2000) For patented inventions, Blackburn et al. U.S. Pat. No. 5,797,563 describes a microwave system to increase aerodynamic efficiency and to decrease the drag force, and Saeks et al. U.S. Pat. No. 6,247,671 describes a method and apparatus to impinge on the shock wave using ions and electrons. However, these systems lack in theoretical explanations and therefore the design aspects to optimize the effect of use of plasma particles in terms of magnetohydrodynamics and plasma physics. The pseudo surface microwave produced plasma shielding system was carefully designed to optimize the effective use of plasma particles from the magnetohydrodynamics and plasma physics point of view.

It has a potential capability to be developed to function as a new type of propulsive device to be replaced with the conventional aircraft engines that use petroleum based fuel. There are a couple of inventions that apply microwave energy to engines. H. Fulenwider, Jr. U.S. Pat. No. 4,064,852 describes a device for pretreatment of vaporizing and heating a liquid fuel using microwave energy before a combustion process and Asmussen et al. U.S. Pat. No. 4,507,588 describes a microwave ion generating apparatus and its application to a space craft engine. However, these devices were not designed to use effective means of heating a propellant and effective means of obtaining a propulsive force. The pseudo surface microwave produced plasma shielding system provides effective means of heating a propellant and obtaining a propulsive force. Overall, this shielding system can offer a simple structure, low cost, low maintenance, long life time, versatile, and flexible defense system and flow field control system.

SUMMARY OF THE INVENTION

The present invention relates to applications of plasma system to a defense system. Specifically, a pseudo surface microwave produced plasma shielding system in which a prescribed plasma environment with a prescribed plasma density gradient surrounds and protects an object as a shield is disclosed. This shielding system is a simple electrodeless device comprising two sets of microwave launcher-receptor systems and a computer system using artificial intelligence (A.I.) integrated with these microwave-receptor systems. The microwave launcher and receptor each has a ring shape but the lengthwise thickness of the receptors is larger than that of the launchers. One set of the microwave launcher and receptor systems (a low power preconditioning microwave system) is for producing a weakly ionized plasma to prepare and pre-condition the environment around the object so that the primary surface microwave can propagate in the preferred direction. The launch ring for this pre-conditioning low power microwave system is mounted on one end of a side surface of the object and the receptor is mounted on the opposite end of the side surface of the object. The other microwave launcher (the primary high power microwave launcher) and receptor system is for producing a strongly ionized plasma to create a prescribed plasma environment with a prescribed plasma density gradient. The launcher and receptor of this primary high power microwave system are mounted at the same ends of the object as the mounting positions of the preconditioning microwave system so that the high power primary microwave propagates in the same direction as that of the preconditioning microwave system. The diameters of the launcher and receptor rings of the primary microwave system are larger than those of the preconditioning microwave system and the rings of this system are mounted apart from the side surface of the object using support beams. When an electromagnetic wave launched from RADAR enters the system, a wave detector catches this incoming radar wave and the information of this wave is analyzed. This information is sent to the equipped computer system with A.I. as inputs. The A.I. looks up the pre-calculated data to determine the appropriate plasma density and its gradient that corresponds to the incoming wave to be deflected from the surface of the object, and adjusts the primary microwave system accordingly.

The present invention extends its defense system application to a stealth capability from SONAR detection. The same microwave launcher-receptor system configuration with a simple modification to employ a microwave antenna can counter an incoming sound wave launched from SONAR. When a sound wave enters the plasma region, it changes the mechanism of propagation from the propagation of an ordinary sound wave to propagation of an ion acoustic wave. The ion acoustic wave propagates partially by thermal motions of ions and partially by electric field oscillation. The part of the propagation mechanism due to electric field oscillation can be canceled by an electric field of 180° out of phase with the wave propagation field. The mobile microwave antenna equipped in this plasma shielding system generates this counteracting electric field to cancel the propagation field. The part of the propagation mechanism due to thermal motions of ions cannot be completely canceled since the ion temperature cannot practically be controlled to be zero. However, the ion temperature perpendicular to the magnetic field in the plasma region can be controlled to be nearly zero by suppressing the diffusion of ions across the magnetic field by increasing the intensity of the magnetic field. The intensity of the magnetic field can be controlled by using A.I. equipped on board and by adjusting intensity of the surface microwaves. When this happens, the ion acoustic wave becomes an Alfven wave propagating along the magnetic field in the plasma region. Therefore, this plasma shielding system can trap and confine a sound wave in the plasma region and does not allow the sound to be reflected. A magnetosonic wave generated by a nuclear explosion can also be altered to Alfven wave in this plasma shield environment since the magnetic field in this plasma shield suppresses ion and electron diffusion, i.e., their collisions.

The present invention also extends its defense system application to a weapon system to generate and launch plasmoids as a plasma gun. In this application, the plasma shielding system comprises the previously described two sets of microwave launcher—receptor systems and a deployable laser launcher—refractor system behind it. When this system functions as a weapon system, a laser launcher ring is deployed form the receptor ring of the primary microwave system and a laser refractor ring with deployable support beams extended from the object. A laser beam launched from the laser launcher forms a conical sheet converging in a direction toward the refractor ring and is refracted through the refractor ring to form a cylindrical laser sheet with much smaller diameter compared to that of the primary surface microwave. With sequential switching operations of the microwave system and the laser system, plasmoids are generated behind the object and accelerated through a pseudo magnetic nozzle produced by the conical and cylindrical laser sheets. These plasmoids are fired at the target with a laser guided precision by pointing the last stage of cylindrical laser sheet as a guiding laser beam. Intensity of a plasmoid in terms of kinetic energy, thermal energy, and electromagnetic energy can be controlled by using A.I. equipped on board and adjusting the intensity of surface microwaves and sheet lasers.

The present invention can also extend its application to a flow field control system such as a boundary layer and turbulence control system, and lift control system to improve flight performance and flight economy of aircraft. When pseudo surface microwaves propagate along entire aircraft surfaces in the streamwise direction, these surface microwaves push plasma particles in the streamwise direction and away from the surfaces at the same time. Through collisions of these plasma particles with neutral air particles near the surfaces, the motions of these plasma particles result in countering the momentum transfer of air particles to the aircraft surfaces as a drag force and also result in reducing the development of eddy currents near surfaces, which ultimately causes turbulence. The amount of drag reduction and eddy current reduction can be controlled by using A.I. equipped on board and by adjusting the intensity of surface microwaves. The pseudo surface microwave can also be used to improve lift performance. The pressure on the lower surface of an airfoil can be increased when a plane surface microwave is launched from the tail end of the airfoil preferably with the distance of boundary layer thickness, and propagates through the plasma region slightly away from the surface preferably with the distance of boundary layer thickness in the opposite direction to the streamwise direction. This is because this surface wave pushes plasma particles against the streamwise direction and toward the surface due to the radiation pressure and due to the effect of the ponderomotive force from the surface microwave and these motions of plasma particles change the momenta of incoming high speed air particles to the momenta that transfer as a surface pressure. An increase of lower surface pressure of the airfoil results in increasing lift of the airfoil. The amount of lift increase can be controlled by using A.I. equipped on board by adjusting the intensity of the surface microwave. In this manner, a pseudo surface microwave produced plasma shielding system can control a flow field around an aircraft and contribute to improved flight performance and flight economy.

The similar plasma environment produced by surface microwaves can be applied to a new type of propulsive device as a method to heat a propellant instead of using a combustion mechanism. This new concept of engine can be replaced with the current aircraft engines that use petroleum based fuel. The same compressor, turbine, and nozzle components in the ordinary jet engine can be used but the combustion chamber can be replaced with a cluster of concentric multi-annular chambers in which each annular chamber functions as an annular wave guide for ring-shape surface microwaves to propagate through the chamber and as a heating chamber to heat propellant particles through collisions with energetic plasma particles. Inside the chambers, a vaporized propellant is injected at the entrance of the chambers and the surface microwaves are launched in the direction opposite to the direction of incoming air in order to maximize ionization of the propellant and the air particles and also maximize the number of particles that transfer their momenta contributing to the engine thrust. If this engine equipped with an afterburner, then the surface microwave is used to further heat the exhaust gas instead of further burning a fuel in the afterburner chamber. The part of output energy from the turbine is extracted to produce electricity to operate the microwave generator and the surfatron generator and to store the electric energy in the battery for the start up of the engine. The thrust level is controlled by using A.I. equipped on board and by adjusting the intensity of microwaves. The pseudo surface microwave produced plasma shielding system provides effective means of heating a propellant and obtaining a propulsive force.

BRIEF DESCRIPTION OF THE DRAWINGS

In the accompanying drawings which illustrates embodiments of the invention.

DETAILED DESCRIPTION OF THE INVENTION

Figure 1:
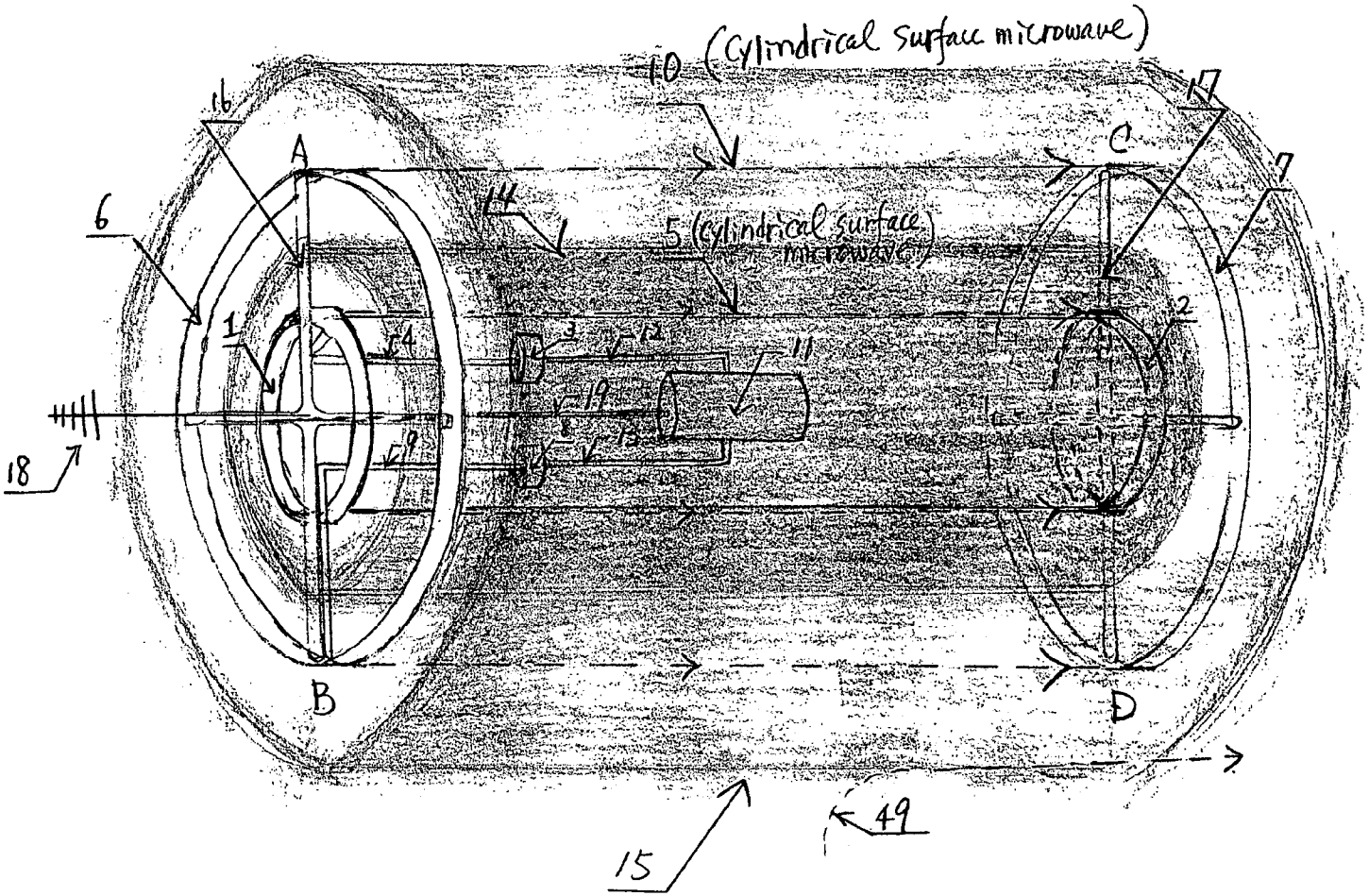
FIG. 1 is a schematic drawing (three dimensional) of a mechanism to shield an incoming electromagnetic wave launched from RADAR in the pseudo surface microwave produced plasma shielding system.

The objectives of the present invention are to provide the ways to produce the plasma shielding system, to provide the ways to apply this plasma shielding system to the engineering field, and to provide the theoretical explanations to the mechanisms of these applications. Therefore, this invention is not limited to the particular processes, geometric configurations, materials, physical properties, e.g., the type of surface waves not limiting to microwaves, and components and their positions in the system disclosed herein as such processes, geometric configurations, materials, physical properties, and components and their positions in the system may vary. The terminology herein is used to describe the particular embodiments only. Therefore, the scope of this invention will not be limited by the terminology herein but will be limited by the following claims in this invention and equivalents thereof.

A plasma has a potential capability to be stealth from RADAR. This capability is due to the electromagnetic and mobile fluid nature of plasma.

For electromagnetic waves in a vacuum without any background magnetic fields, i.e., without any magnetic fields created by direct currents, the dispersion relation is obtained from the Maxwell equations stating Faraday's law and Ampere's law.

$$\nabla \times E_1 = -\frac{\partial B_1}{\partial t} \tag{1.1}$$

$$\nabla \times B_1 = \varepsilon_0 \mu_0 \frac{\partial E_1}{\partial t} \tag{1.2}$$

Taking the curl of the equation (1.2) and substituting this into the time derivative of equation (1.1), we obtain $$\nabla \times (\nabla \times B_1) = \varepsilon_0 \mu_0 \nabla \times \left(\frac{\partial E_1}{\partial t}\right) = -\varepsilon_0 \mu_0 \frac{\partial^2 B_1}{\partial t^2} \tag{1.3}$$

Using Fourier transformation, we can replace the special derivative $\nabla$ with ik and the time derivative $$\frac{\partial}{\partial t}$$

with—iω. Applying these operators in the equation (1.3), we obtain $$-k\times(k\times B_1)=\epsilon_0\mu_0\omega^2 B_1 \tag{1.4}$$

Since A×(B×C)=(A·C)B−(A·B)C, $$-k\times(k\times B)=-(k\cdot B_1)k+(k\cdot k)B_1=-k(k\cdot B_1)+k^2 B_1 \tag{1.5}$$

However, we can rewrite $k\cdot B_1=-i\nabla\cdot B_1=0$ since one of the Maxwell equations states that there is no monopole for magnetic fields. Therefore, using this relation, the equation (1.4) becomes $$k^2 B_1 = \varepsilon_0 \mu_0 \omega^2 B_1 = \frac{\omega^2}{c^2} B_1 \tag{1.6}$$

$$\omega^2 = k^2 c^2 \tag{1.7}$$

The equation of dispersion relation in a plasma, however, becomes different due to the perturbed currents from first-order charged particle motions. The equation of Ampere's law in a vacuum (1.2) is changed as follows:

$$\nabla \times B_1 = \mu_0 j_1 + \varepsilon_0 \mu_0 \frac{\partial E_1}{\partial t} \tag{1.8}$$

Taking time derivative of the equation (1.8) and substituting this into the curl of equation (1.1), we obtain $$\nabla \times (\nabla \times E_1) = -\nabla \times \frac{\partial B_1}{\partial t} = -\mu_0 \frac{\partial j_1}{\partial t} - \varepsilon_0 \mu_0 \frac{\partial^2 E_1}{\partial t^2} \tag{1.9}$$

Applying Fourier transformation and expanding a double curl operation, we obtain $$-k\times(k\times E_1)=-(k\cdot E_1)k+(k\cdot k)E_1=i\omega\mu_0 j_1+\omega^2\epsilon_0\mu_0 E_1 \tag{1.10}$$

Since we are considering transverse waves, $k\cdot E_1=0$ and this reduces the equation (1.10) to $$\left(\frac{\omega^2}{c^2} - k^2\right) E_1 = -i\omega\mu_0 j_1 \tag{1.11}$$

where $$\varepsilon_0 \mu_0 = \frac{1}{c^2}.$$

The perturbed current j can be considered as electron motions only since ions will not have enough time to respond to those electron motions responding high frequency light waves or microwaves. Therefore, the perturbed current j is expressed as $$j_1=-en_0 v_{e1} \tag{1.12}$$

If we apply the linearized equation of motion for electrons, $$m\frac{\partial v_{e1}}{\partial t} = -eE_1 \tag{1.13}$$

Applying Fourier transformation, $$e_{e1} = \frac{eE_1}{i\omega m} \tag{1.14}$$

Substituting (1.14) into (1.12) and further substituting this into (1.11) gives $$\left(\frac{\omega^2}{c^2} - k^2\right)E_1 = i\omega\mu_0\frac{e^2 n_0 E_1}{i\omega m} = \frac{\mu_0 e^2 n_0 E_1}{m} \tag{1.15}$$

Multiplying $c^2$ to both sides of (1.15), $$(\omega^2 - c^2k^2)E_1 = \frac{\mu_0 e^2 n_0 E_1}{\varepsilon_0\mu_0 m} = \frac{e^2 n_0}{\varepsilon_0 m}E_1 \tag{1.16}$$

Therefore, $$\omega^2 = \frac{e^2 n_0}{\varepsilon_0 m} + c^2k^2 = \omega_p^2 + c^2k^2 \tag{1.17}$$

This is the dispersion relation for electromagnetic waves propagating in a plasma without any background magnetic field. It is simple to notice that the dispersion relation for electromagnetic waves in a vacuum is modified by the term of plasma frequency (plasma oscillation) $\omega_p^2$. Unlike the dispersion relation of electromagnetic waves in a vacuum (1.7), this dispersion relation indicates an existence of the cutoff frequency of a propagating wave in a plasma. When the plasma density is increased, the plasma frequency $\omega_p$ is increased. For a given frequency $\omega$ of an incoming electromagnetic wave, the wavelength becomes longer as the plasma density becomes higher since the wave number k becomes smaller in order to maintain the same value of $\omega$. At a certain value of plasma density, the wave number of the propagating wave becomes zero and its wavelength becomes infinity. When this happens, the wave no longer propagates in the plasma and reflects back from the plasma.

The dispersion relation of the equation (1.17) also indicates that the index of refraction ñ of a plasma is less than unity since $$\tilde{n} = \frac{c}{v_\phi} = \frac{ck}{\omega} < 1 \tag{1.18}$$

This means that a plasma is a dispersive medium. If we make a convex plasma lens with the density profile of its maximum at the center of the plasma, the light going through this plasma convex lens will diverge. The opposite is true for a concave plasma lens with the density profile of its minimum at the center of the plasma. The light going through this plasma concave lens will converge.

Knowing this nature of plasma, if we can design the plasma environment to surround an object in a way that an electromagnetic wave propagates through the plasma but deflects away from the surface of the object, then the system with this plasma environment will not be detected by RADAR. When a microwave travels through a plasma, the radiation pressure or the ponderomotive force from the wave pushes plasma particles away from the wave. This type of radiation pressure can reach up to several hundred thousand atmospheric pressure. If there is no physical boundary to confine the plasma particles, then the density profile of the plasma created by the ponderomotive force from the microwave eventually reaches to the steady state after collisions and diffusions of charged and neutral particles with charged particle source created by the microwave. The steady state condition of plasma density profile and the appropriate density profile to deflect an incoming electromagnetic wave can be obtained by a numerical solution of a set of two-fluid magnetohydrodynamic (MHD) equations of the plasma for the system. However, the continuity equation, the momentum equation, and the energy equation for this system must include the effects of the microwave, i.e., the particle source term by ionization from the wave for the continuity equation, the ponderomotive force term from the wave for the momentum equation for electrons, and the energy source or energy flow term from the wave for the energy equation.

The mass continuity equation for ions in the set of two-fluid MHD equations is written as follows:

$$\frac{\partial\{m_i n_i(r,t)\}}{\partial t} + \nabla_r\cdot\{m_i n_i(r,t)V_i(r,t)\} = m_i\{S_i(r,t) - L_i(r,t)\} \tag{1.19}$$

where $S_i(r,t)$ is the rate of ion source and $L_i(r,t)$ is the rate of ion loss. The ion source from ionization by microwave energy deposition is included in $S_i(r,t)$. In a similar manner, the mass continuity equation for electrons in the set of two-fluid MHD equations is written as follows:

$$\frac{\partial\{m_e n_e(r,t)\}}{\partial t} + \nabla_r\cdot\{m_e n_e(r,t)V_e(r,t)\} = m_e\{S_e(r,t) - L_e(r,t)\} \tag{1.20}$$

where $S_e(r,t)$ is the rate of electron source and $L_e(r,t)$ is the rate of electron loss. The electron source from ionization by microwave energy deposition is included in $S_e(r,t)$. The charge continuity equation for ions in the set of two-fluid MHD equations is written as follows:

$$\frac{\partial q_i n_i(r,t)\}}{\partial t} + \nabla_r\cdot\{q_i n_i(r,t)V_i(r,t)\} = q_i\{S_i(r,t) - L_i(r,t)\} \tag{1.21}$$

where $q_i$=e. In a similar manner, the charge continuity equation for electrons in the set of two-fluid MHD equations is written as follows:

$$\frac{\partial q_e n_e(r,t)}{\partial t} + \nabla_r\cdot\{q_e n_e(r,t)V_e(r,t)\} = q_e\{S_e(r,t) - L_e(r,t)\} \tag{1.22}$$

where $q_e$=−e. Since the ponderomotive force on the ions is smaller by the factor of m/M, this term becomes negligible for ions. Therefore, the momentum equation for ions in the set of two-fluid MHD equations is written as follows:

$$m_i n_i(r,t)\left\{\frac{\partial}{\partial t}+V_i(r,t)\cdot\nabla_r\right\}V_i(r,t)= -\nabla_r p_i(r,t)-\nabla_r:\pi_{ie}(r,t)+n_i(r,t)q_i\{E(r,t)+V_i(r,t)\times B(r,t)\}- m_i n_i(r,t)\{V_i(r,t)-V_e(r,t)\}\langle\nu_{ie}\rangle \tag{1.23}$$

where $\square_{ie}$ is off diagonal stress tensor components. For the momentum equation for electrons in the set of two-fluid MHD equations, the ponderomotive force term is added as follows:

$$m_e n_e(r,t)\left\{\frac{\partial}{\partial t}+V_e(r,t)\cdot\nabla_r\right\}V_e(r,t)= -\nabla_r p_e(r,t)-\nabla_r:\pi_{ei}(r,t)+n_e(r,t)q_e\{E(r,t)+V_e(r,t)\times B(r,t)\}- m_e n_e(r,t)\{V_e(r,t)-V_i(r,t)\}\langle\nu_{ei}\rangle-\frac{\omega_p^2}{\omega^2}\nabla\frac{\langle\varepsilon(r,t)E(r,t)^2\rangle}{2} \tag{1.24}$$

By adding the energy flow rate based on Poynting theorem, the energy equation for ions in the set of two-fluid MHD equations is written as follows:

$$\frac{n_i(r,t)}{\gamma-1}\left\{\frac{\partial}{\partial t}+V_i(r,t)\cdot\nabla_r\right\}\{KT_i(r,t)\}= -n_i(r,t)\{KT_i(r,t)\}\nabla_r\cdot V_i(r,t)-\pi_{ie}(r,t):V_r\cdot V_i- \nabla_r\cdot q_{ih}+E(r,t)\cdot J(r,t)+\nabla_r\cdot\left\{E(r,t)\times\frac{B(r,t)}{\mu(r,t)}\right\}-Q_{iL} \tag{1.25}$$

where $q_{ih}$ is the ion heat flux and $Q_{iL}$ is the ion heat loss rate. In a similar manner, the energy equation for electrons in the set of two-fluid MHD equations is written as follows:

$$\frac{n_e(r,t)}{\gamma-1}\left\{\frac{\partial}{\partial t}+V_e(r,t)\cdot\nabla_r\right\}\{KT_e(r,t)\}= -n_e(r,t)\{KT_e(r,t)\}\nabla_r\cdot V_e(r,t)-\pi_{ei}(r,t):V_r\cdot V_e- \nabla_r\cdot q_{eh}+E(r,t)\cdot J(r,t)+\nabla_r\cdot\left\{E(r,t)\times\frac{B(r,t)}{\mu(r,t)}\right\}-Q_{eL} \tag{1.26}$$

where $q_{eh}$ is the electron heat flux and $Q_{eL}$ is the electron heat loss rate. Maxwell's equations are written as follows:

(1) Gauss' Law: $$\nabla_r\cdot E(r,t)=\frac{1}{\varepsilon(r,t)}\{n_i(r,t)q_i+n_e(r,t)q_e\} \tag{1.27}$$

(2) Faraday's Law: $$\nabla_r\times E(r,t)=-\frac{\partial B(r,t)}{\partial t} \tag{1.28}$$

(3) No monopole for B: $$\nabla_r\cdot B(r,t)=0 \tag{1.29}$$

(4) Ampere's Law:

$$\nabla_1\times B(r,t)= \mu(r,t)\left\{\varepsilon(r,t)\frac{\partial E(r,t)}{\partial t}n_i(r,t)q_iV_i(r,t)+n_0(r,t)q_eV_o(r,t)\right\} \tag{1.30}$$

One more equation for closure of the set of MHD equations becomes the equation of state for ions and electrons with the assumption that both ions and electrons in the plasma are considered as an ideal gas. These equations of state are written as follows:

For ions: $$P_i(r,t)=n_i(r,t)KT_i(r,t) \tag{1.31}$$

For electrons: $$P_e(r,t)=n_e(r,t)KT_e(r,t) \tag{1.32}$$

I have been developing a very sophisticated computer code called "Comprehensive and Advanced Fusion Plasma Analytical Code (CAFPAC). This code has many different modules with many different models, for example, the MHD model, the Transport model, the Hybrid model, and the Kinetic model, in order to analyze plasmas from the macroscopic to the microscopic point of views. This computer code is capable to analyze and study the more complicated physics of the plasma system in the particulate level, for example, the physics of the particle-wave interactions and of the wave-wave interactions in addition to the physics of the particle-particle interactions. Therefore, the data obtained from CAFPAC will be one of the most suitable data for this plasma shielding system.

The density profile and the maximum density of the system plasma at the steady state can be changed by adjusting the intensity of the surface microwave. If the system is equipped with an artificial intelligence system (A.I.) such that an incoming wave is instantly analyzed and the optimal condition of the plasma environment such as the density profile and the maximum density of the plasma is instantly obtained from the pre-calculated data file corresponding to this particular incoming wave from RADAR, then the system launches and adjusts a microwave (a cylindrical surface type wave) to create this plasma environment (hereafter plasma shield) to surround an object so that the object is not detected by RADAR by deflecting the wave away from the surface of the object. A schematic drawing of a mechanism to shield an incoming electromagnetic wave launched from RADAR in the pseudo surface microwave produced plasma shielding system is shown in FIG. 1.

A cylindrical object is considered in this embodiment. A ring shape surface microwave launcher 1 is attached at one end side surface of the object. A ring shape receptor 2 is attached at the other end side surface of the object. A power source 3 for this surface microwave launcher 1 is placed inside the object and a power cable 4 is connected to the surface microwave launcher 1 from the power source 3. The power source 3 uses lithium tantalate crystal, which is pyroelectric to be able to produce 100,000 volts when it is warmed by 50° F. This power source can be compact and light weight as a cylinder only about an inch and a quarter in diameter and a half-inch in length to be able to produce this amount of electric potential. A surface microwave 5 launched from the launcher 1 produces a plasma region in the vicinity of the launcher 1 and propagates through the plasma sheath near the surface of the object as the plasma region expands forward. At the other end of the object, the surface microwave is received by the receptor 2 and terminates the production of plasma therein. This process results in producing a steady state finite region of plasma shielding that surrounds the object with a plasma density profile in which the direction of the density gradient is in the positive radial direction (less dense at the surface and more dense at the region away from the surface). This density profile is created due to the radiation pressure and due to the effect of the ponderomotive force from the surface microwave. The surface microwave 5 mainly functions as a preconditioning surface microwave to produce a plasma region for the primary surface microwave to propagate through it. A weak microwave can be used to produce a weakly ionized plasma for this purpose. However, the surface microwave launcher 1 should have a capability to change the wave intensity.

Another ring shape surface microwave launcher 6 is mounted at just outside of the same end plane of the object where the launcher 1 is mounted. The launcher 6 has a larger diameter compared to that of the launcher 1 and is mounted by support beams 16. The launcher 6 is an adjustable launcher that includes a mechanical device similar to the aperture of a camera to be able to adjust its diameter size. In a similar manner, a ring shape receptor 7 is mounted at just outside of the same end plane of the object where the receptor 2 is mounted. The receptor 7 also has a larger diameter compared to that of the receptor 2 and is mounted by support beams 17. The receptor 7 is also an adjustable receptor that includes the same mechanical device as one in the launcher 6 to be able to adjust its diameter size. A power source 8 for this surface microwave launcher 6 is placed inside the object and a power cable 9 is connected to the surface microwave launcher 6 from the power source 8. The power source 8 also uses lithium tantalate crystal pyroelectrics to produce a strong electrical field. A surface microwave 10 (hereinafter called the primary surface microwave) launched from the launcher 6 produces a plasma region in the vicinity of the launcher 6 and propagates through the plasma region already created by the preconditioning surface microwave 5 together with the forward movement of the plasma produced in the vicinity of the launcher 6. At the other end of the object, the surface microwave 10 is received by the receptor 7 and terminates the production of plasma therein. This process also results in producing two finite regions of plasma shielding that surrounds the object and the preconditioning surface microwave. One of the plasma shielding regions exists between the preconditioning surface microwave S and the primary surface microwave 10. This plasma region is created partially from the preconditioning microwave 5 and partially from the primary surface microwave 10 due to the radiation pressure and due to the effect of the ponderomotive force from the these surface microwaves 5 and 10. It has a density profile in which the plasma is denser in the region toward the middle region between the surface microwaves 5 and 10 and becomes less dense in the region toward the surface microwaves 5 and 10. Another plasma shielding region exists outside of the surface microwave 10. It has a density profile in which the plasma is denser in the region away from the primary surface microwave 10 and becomes less dense in the region toward the surface microwaves 10. The surface microwave 10 mainly functions as the primary surface microwave to produce a prominent plasma shielding region 14 with a sharp density gradient and a high maximum plasma density. It also functions as the secondary surface microwave to produce the secondary plasma shielding region 15 with relatively moderate density profile and a moderate maximum plasma density. A high powered microwave will be used to produce a relatively strongly ionized plasma for this purpose. The primary surface microwave 10 can be created at the different radial position using said mechanical device in order to produce the plasma shielding region with different intensity. The surface microwave launcher 6 should also have a capability to change the wave intensity.

Figure 2:
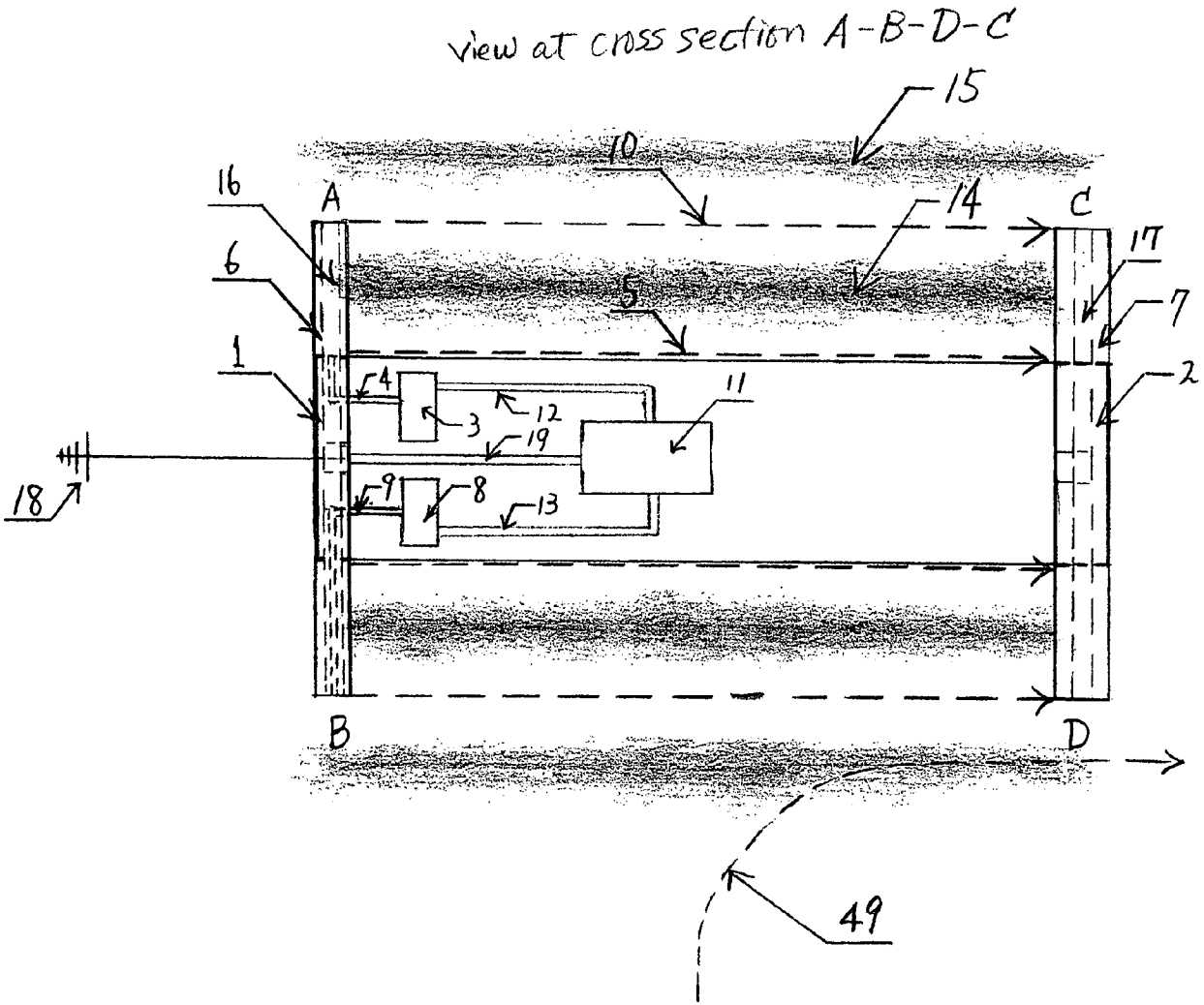
FIG. 2 is a schematic drawing (cross section A-B-D-C) of a mechanism to shield an incoming electromagnetic wave launched from RADAR in the pseudo surface microwave produced plasma shielding system.
Figure 3:
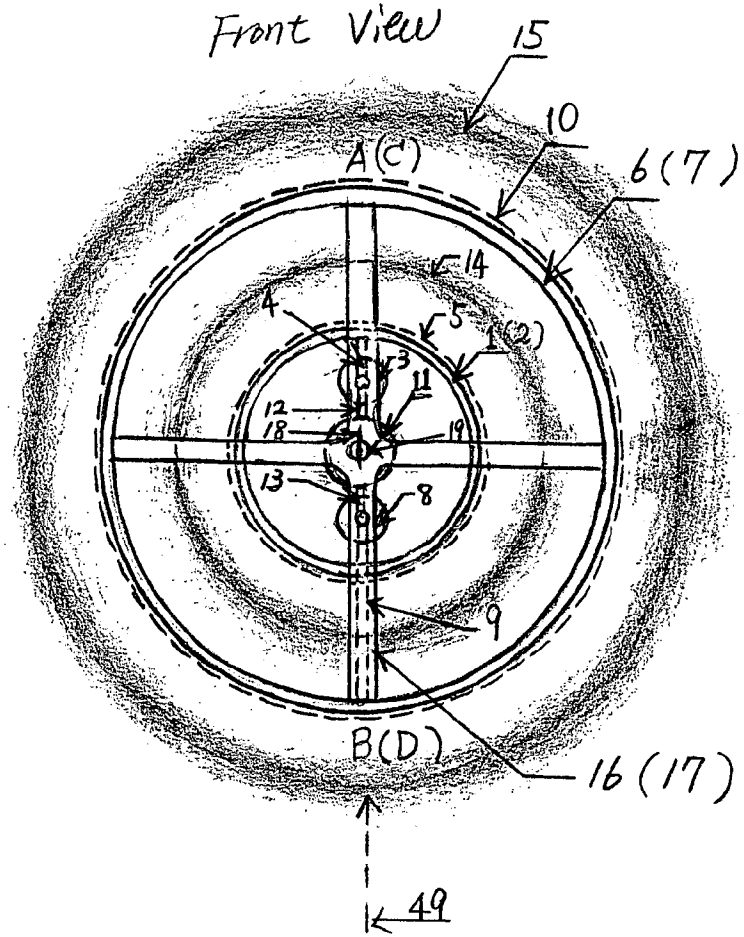
FIG. 3 is a schematic drawing (front view) of a mechanism to shield an incoming electromagnetic wave launched from RADAR in the pseudo surface microwave produced plasma shielding system.

When an electromagnetic wave 49 launched from RADAR enters to this plasma shielding system, a wave detector 18 catches this wave and the information of this wave is sent to the equipped computer system with artificial intelligence (A.I.) 11 through a transmission line 19 and analyzed by the computer. The A.I. 11 looks up the precalculated data to determine the appropriate plasma density and its gradient that counters the incoming wave to deflect it from the surface of the object. Once the condition of plasma to counter the incoming wave 49 is determined, the A.I. 11 sends signals to the power source 3 through a transmission line 12 and to the power source 8 through a transmission line 13. The power sources 3 and 8 that received those signals from A.I. 11 adjust their surface microwaves intensities to produce prescribed plasma shielding regions to deflect the incoming wave. The cut away view of this plasma shielding system at the cross section A-B-D-C is shown in FIG. 2 and the front view of this plasma shielding system is shown in FIG. 3

This same plasma shielding environment can provide another mechanism to be a natural shield to incoming electromagnetic waves. A laser beam can produce a plasma with a self-generated azimuthal magnetic field around it due to fast electrons' motions within the skin depth of the plasma and due to Weibel instability. It is expected that the pseudo surface microwave can also create this self-generated magnetic field around it. If the direction of the oscillating E field of the incoming transverse wave is parallel to the direction of this magnetic field or the created magnetic field is weak compared to the perturbed E field of the incoming wave, then the previously discussed method will work to encounter the wave from RADAR. However, if the created magnetic field is strong enough and the perturbed E field of the incoming transverse wave is perpendicular or not parallel to the direction of this magnetic field, then the plasma environment for this case resembles a transverse electric and magnetic (TEM) wave guide to alter the incoming transverse wave to an extraordinary wave (or an elliptically polarized wave).

If we take a direction of the wave propagation k as the x-direction, a direction of the oscillating $E_1$ field in the wave as both the x-direction and the y-direction (waves with $E_1 \square B_0$ tend to be elliptically polarized instead of plane polarized), and a direction of the background $B_0$ field in the plasma as the z-direction, then the Fourier transformed wave equation and the linearized equation of motion for electrons become as follows:

$$(\omega^2 - c^2k^2)E_1 + c^2|kE_x|k = -\frac{i\omega j_1}{\varepsilon_0} \tag{1.27}$$

$$-i\omega m v_{e1} = -e(E_1 + v_{e1} \times B_0) \tag{1.28}$$

Applying $j_1 = -en_0 v_{e1}$, if we write these equations in each direction, $$\omega^2 E_x = -\frac{i\omega n_0 e}{\varepsilon_0} v_{ex} \tag{1.29}$$

$$(\omega^2 - c^2k^2)E_y = -\frac{i\omega n_0 e}{\varepsilon_0} v_{ey} \tag{1.30}$$

$$v_{ex} = -\frac{ie}{m\omega}(E_x + v_{ey}B_0) \tag{1.31}$$

$$v_{ey} = -\frac{ie}{m\omega}(E_y - v_{ex}B_0) \tag{1.32}$$

Solving (1.31) and (1.32) for $v_{ex}$ and $v_{ey}$, we obtain $$v_{ex} = \frac{e}{m\omega}\left(-iE_x - \frac{\omega_c}{\omega}E_y\right)\left(1 - \frac{\omega_c^2}{\omega^2}\right)^{-1} \tag{1.33}$$

$$v_{ey} = \frac{e}{m\omega}\left(-iE_y + \frac{\omega_c}{\omega}E_x\right)\left(1 - \frac{\omega_c^2}{\omega^2}\right)^{-1} \tag{1.34}$$

where $\square_c$ is the electron cyclotron frequency and $$\omega_c = \frac{eB}{m}.$$

Substituting (1.33) into (1.29) and (1.34) into (1.30), we obtain $$\left[\omega^2\left(1 - \frac{\omega_c^2}{\omega^2}\right) - \omega_p^2\right]E_x + i\frac{\omega_p^2\omega_c}{\omega}E_y = 0 \tag{1.35}$$

$$\left[(\omega^2 - c_2k^2)\left(1 - \frac{\omega_c^2}{\omega^2}\right) - \omega_p^2\right]E_y - i\frac{\omega_p^2\omega_c}{\omega}E_x = 0 \tag{1.36}$$

where $\omega_p$ is the plasma frequency and $$\omega_p^2 = \frac{n_0e^2}{m\varepsilon_0}.$$

The determinant must vanish in order for $E_x$ and $E_y$ to exist as solutions. Therefore, $$(\omega^2 - \omega_h^2)\left[\omega^2 - \omega_h^2 - c^2k^2\left(1 - \frac{\omega_c^2}{\omega^2}\right)\right] = \left(\frac{\omega_p^2\omega_c}{\alpha\omega}\right)^2 \tag{1.37}$$

where $\omega_h$ is the upper hybrid frequency and $\omega_h^2=\omega_p^2+\omega_c^2$. If we express this equation for $$\frac{c^2k^2}{\omega^2}$$

or in terms of the phase velocity $$\frac{c^2}{v_\phi^2}$$

with some mathematical manipulation, $$\frac{c^2k^2}{\omega^2} = \frac{c^2}{v_\phi^2} = 1 - \frac{\omega_p^2}{\omega^2}\frac{\omega^2 - \omega_p^2}{\omega^2 - \omega_h^2} \tag{1.38}$$

This is the dispersion relation for the TEM wave in a plasma. Although this equation was derived in Cartesian coordinates, the result is same for any other coordinates.

The equation (1.38) indicates that a resonance frequency of the TEM wave exist at $\omega=\omega_h=\sqrt{\omega_p^2+\omega_c^2}$. Since $\omega_h$ depends on the plasma frequency and electron cyclotron frequency, it depends on the plasma density and the strength of the background magnetic field in the plasma. Therefore, a plasma condition to meet this wave condition can exist within the plasma shield or can be created if it does not exist, and the incoming transverse wave from RADAR will be absorbed when the wave propagates through the plasma shield.

As an overall function, the plasma shield created in this method will protect an object surrounded by it from an incoming wave from RADAR regardless its wave mode.

A plasma has a potential capability to be stealth from SONAR as well. This capability is due to said electromagnetic and mobile fluid nature of plasma.

An ordinary sound wave can propagate through a plasma. The mechanism of wave propagation in a plasma, however, will be different due to from neutral particle collisions to charged particles collisions. While the ordinary sound wave propagates as a pressure wave by collisions among neutral air particles, an ion acoustic wave (ion wave) propagates by oscillations of massive ions responding to the perturbed electric field in the plasma.

The dispersion relation for the ordinary sound wave is obtained from the continuity equation and Navier-Stokes equation. The continuity equation is written as $$\frac{\partial\rho}{\partial t} + \nabla\cdot(\rho v) = 0 \tag{2.1}$$

Neglecting viscosity and applying the equation of state, the Navier-Stokes equation is written as $$\rho\left[\frac{\partial v}{\partial t} + (v\cdot\nabla)v\right] = -\nabla p = -\frac{\gamma p}{\rho}\nabla\rho \tag{2.2}$$

Linearizing those equations and applying the Fourier transformation, we obtain $$-i\omega\rho_1+i\rho_0 k\cdot v_1=0 \tag{2.3}$$

$$-i\omega\rho_0 v_1 = -i\frac{\gamma p_0}{\rho_0}k\rho_1 \tag{2.4}$$

Since we are considering a plane wave, the direction of wave propagation coincides with that of particle motions. Solving (2.3) for $\rho_1$ and substituting this into (2.4), we obtain $$\omega^2|v_1| = |k|^2\frac{\gamma p_0}{\rho_0}|v_1| \tag{2.5}$$

Expressing this for the phase velocity (the speed of sound in this case), we obtain $$\frac{\omega}{k} = c_s = \sqrt{\frac{\gamma p_0}{\rho_0}} = \sqrt{\frac{\gamma KT}{M}} \tag{2.6}$$

where K is Boltzmann's constant, T is the plasma temperature, and M is the ion mass. On the other hand, the dispersion relation for the ion wave is obtained from the continuity equation of ions, the equation of motion of the MHD equations for ions, and the equation of Boltzmann relation for electrons. The continuity equation of ions is written as $$\frac{\partial n_i}{\partial t} + \nabla\cdot(n_i v_i) = 0 \tag{2.7}$$

Linearizing this equation, we obtain $$i\omega n_{i1}=ikn_0 v_{i1} \tag{2.8}$$

Applying $E=-\nabla\phi$ and the equation of state, we write the equation of motion for ions as $$Mn\left[\frac{\partial v_i}{\partial t} + (v_i\cdot\nabla)v_i\right] = enE - \nabla p = -en\nabla\phi - \gamma_i KT_i\nabla n_i \tag{2.9}$$

Linearizing this equation, we obtain $$-i\omega Mn_0 v_{i1}=-iken_0\phi_1-ik\gamma_i KT_i n_{i1} \tag{2.10}$$

The equation of Boltzmann relation for electrons is written as $$n_e = n_0\exp\left(\frac{e\phi_1}{KT_e}\right) = n_0\left(1 + \frac{e\phi_1}{KT_e} + \ldots\right) \tag{2.11}$$

Using the plasma approximation ($n_i=n_e=n$), the perturbed part of plasma density is expressed as $$n_{e1} = n_{i1} = n_0\frac{e\phi_1}{KT_e} \tag{2.12}$$

Solving this equation for $\phi_1$ and substituting it into (2.10), we obtain $$\omega Mn_0 v_{i1}=k(KT_e+\gamma_i KT_i)n_{i1} \tag{2.13}$$

Expressing (2.8) for $n_{i1}$ and substituting it into (2.13), we obtain $$\omega^2 = k^2\left(\frac{KT_e + \gamma_i KT_i}{M}\right) \tag{2.14}$$

Rewriting this equation for the phase velocity (the speed of sound in a plasma), $$\frac{\omega}{k} = v_s = \sqrt{\frac{KT_e + \gamma_i KT_i}{M}} \tag{2.15}$$

This is the dispersion relation for ion acoustic waves. This equation implies two different mechanisms of sound wave propagation. The first mechanism is to form regions of compression and rarefaction due to ion thermal motions, which is expressed as the second term in (2.15). The second mechanism is to form regions of compression and rarefaction due to an ion charge bunching effect and its electric field oscillation, which is expressed as the first term in (2.15).

The mechanism of ion wave propagation in a plasma implies that the incoming plasma sound wave can be damped out electromagnetically instead of reflecting back from the boundary of an object. Therefore, if we can find a method to damp out and control this incoming plasma sound wave in an electromagnetic manner, then an object surrounded by this plasma environment cannot be detected by SONAR. It is possible to create such a plasma environment around an object in the seawater, for example, the seawater MHD propulsion system or the plasma shielding system described in the previous section, that the ion temperature subject to the direction of the sound wave propagation is nearly zero and an artificially created oscillating electric field cancels the electric field created by the charge bunching effect of ions. If we consider a plasma shielding system similar to the one described in the previous section, the system produces a similar plasma environment described in the section (1). In this plasma, we can consider two different ion temperatures, $T_{\parallel}$ that is the ion temperature parallel to the background magnetic field $B_0$ (azimuthal) and $T_{\perp}$ that is the ion temperature perpendicular to $B_0$. Although it is not easy to create a cold plasma in this system in which ion temperature becomes zero, it is possible to create a plasma with a condition in which the ion temperature perpendicular to $B_0$ becomes nearly zero by suppressing ion diffusion across $B_0$, i.e., suppressing collisions of ions. The suppression of ion diffusion across $B_0$ can be done by increasing the intensity of $B_0$ since the diffusion coefficient of ions for the direction perpendicular to $B_0$ is inversely proportional to $B_0^2$. The diffusion coefficient for the direction perpendicular to $B_0$ is obtained as follows:

The perpendicular component of the fluid equation of motion for ions or electrons is expressed as $$mn\frac{dv_\perp}{dt} = \pm en(E + v_\perp \times B) - KT\nabla n - mn\nu v_\perp \tag{2.16}$$

If we assume that the collisions are frequent enough to consider to be a steady state and if we write this equation in Cartesian coordinates, $$mn\nu v_x = \pm enE_x - KT\frac{\partial n}{\partial x} \pm env_yB \tag{2.17}$$

$$mn\nu v_y = \pm enE_y - KT\frac{\partial n}{\partial y} \pm env_xB$$

Dividing both sides of the above equations with mn□, $$v_x = \pm\frac{e}{m\nu}E_x - \frac{KT}{m\nu}\frac{1}{n}\frac{\partial n}{\partial x} \pm \frac{e}{m\nu}v_yB \tag{2.18}$$

$$v_y = \pm\frac{e}{m\nu}E_y - \frac{KT}{m\nu}\frac{1}{n}\frac{\partial n}{\partial y} \pm \frac{e}{m\nu}v_xB$$

Since the mobility □ is defined as $$\mu = \frac{e}{m\nu}$$

and the diffusion coefficient D is defined as $$D = \frac{KT}{m\nu},$$

also the cyclotron frequency $\square_c$ is defined as $$\omega_c = \frac{eB}{m},$$

the equations (2.18) are rewritten as $$v_x = \pm\mu E_x - D\frac{1}{n}\frac{\partial n}{\partial x} \pm \frac{\omega_c}{\nu}v_y \tag{2.19}$$

$$v_y = \pm\mu E_y - D\frac{1}{n}\frac{\partial n}{\partial y} \pm \frac{\omega_c}{\nu}v_x$$

If we the above equations for $v_x$ and $v_y$, $$v_x = \pm\frac{\mu}{1+\omega_c^2\tau^2}E_x - \frac{D}{1+\omega_c^2\tau^2}\frac{1}{n}\frac{\partial n}{\partial x} + \frac{\omega_c^2\tau^2}{1+\omega_c^2\tau^2}\frac{E_y}{B} \mp \frac{\omega_c^2\tau^2}{1+\omega_c^2\tau^2}\frac{KT}{eB}\frac{1}{n}\frac{\partial n}{\partial y} \tag{2.20}$$

-continued $$v_y = \pm\frac{\mu}{1+\omega_c^2\tau^2}E_y - \frac{D}{1+\omega_c^2\tau^2}\frac{1}{n}\frac{\partial n}{\partial y} - \frac{\omega_c^2\tau^2}{1+\omega_c^2\tau^2}\frac{E_x}{B} \pm \frac{\omega_c^2\tau^2}{1+\omega_c^2\tau^2}\frac{KT}{eB}\frac{1}{n}\frac{\partial n}{\partial x}$$

The third terms in the above equations are the E×B drift terms and then fourth terms are the diamagnetic drift terms. If we use $v_E$ and $v_D$ for those term and express the equation in a vector quantity, we obtain $$v_\perp = \pm\frac{\mu}{1+\omega_c^2\tau^2}E - \frac{D}{1+\omega_c^2\tau^2}\frac{\nabla n}{n} + \frac{v_E + v_D}{1+(\nu^2/\omega_c^2)} \tag{2.21}$$

If we define the perpendicular mobility and perpendicular diffusion coefficients, the above equation is rewritten as $$v_\perp = \pm\mu_\perp E - D_\perp\frac{\nabla n}{n} + \frac{v_E + v_D}{1+(\nu^2/\omega_c^2)} \tag{2.22}$$

Then the perpendicular mobility and perpendicular diffusion coefficients are expressed as $$\mu_\perp = \frac{\mu}{1+\omega_c^2\tau^2} \quad D_\perp = \frac{D}{1+\omega_c^2\tau^2} \tag{2.23}$$

As we can see in these equations, the mobility and diffusion coefficient perpendicular to $B_0$ become smaller as $\square_c$ increases, i.e. $B_0$ increases.

If the ion wave is controlled in a manner described above, then it will propagate only in the direction of $B_0$ by circling around the object, and it will not be reflected back from the object. Therefore, it becomes undetectable to SONAR.

When the strength of background magnetic field becomes comparable to the perturbed electric field in the ion wave, then the propagating wave becomes the magnetosonic wave. The dispersion relation for this wave is written as follows:

$$\frac{\omega^2}{k^2} = c^2\frac{v_s^2 + v_A^2}{c^2 + v_A^2} \tag{2.24}$$

where $v_S$ is an ordinary speed of sound and $v_A$ is Alfven speed.

As we can see in this equation, when the perturbed electric field of the wave is manipulated to be null and the ion temperature perpendicular to $B_0$ is also manipulated to be nearly zero, then the magnetosonic wave has a characteristic of Alfven wave only that propagates along $B_0$. This is especially true when the strength of $B_0$ is increased and the effect of $B_0$ dominates over that of $E_1$. This equation also describes the incoming sound wave can be controlled in a manner that the wave changes its direction to be confined along $B_0$.

If this system is also equipped with A.I. such that the perturbed electric field in the propagating ion wave is analyzed by a probe immediately after the sound wave from SONAR enters into the plasma region and the system generates the electric field oscillating 180 degrees out of phase to counteract the oscillating electric field in the ion wave, and also that the system creates an azimuthal magnetic field much stronger than the perturbed electric field in the ion wave, then the ion wave or the magnetosonic wave will be confined along $B_0$ circulating around the object and this object surrounded by this plasma system will not be detected by SONAR. This plasma shielding system can further protect electronics devices in the object from EMP generated from a nuclear explosion by capturing and confining magnetosonic waves in the shielding system. It can also protect the object from the harmful chemical and biological agents since the plasma can dissociate and decompose chemical compounds, and kill any virus and bacteria and sanitize the environment. The schematic of this plasma shielding system is shown in FIG. 4.

Figure 4:
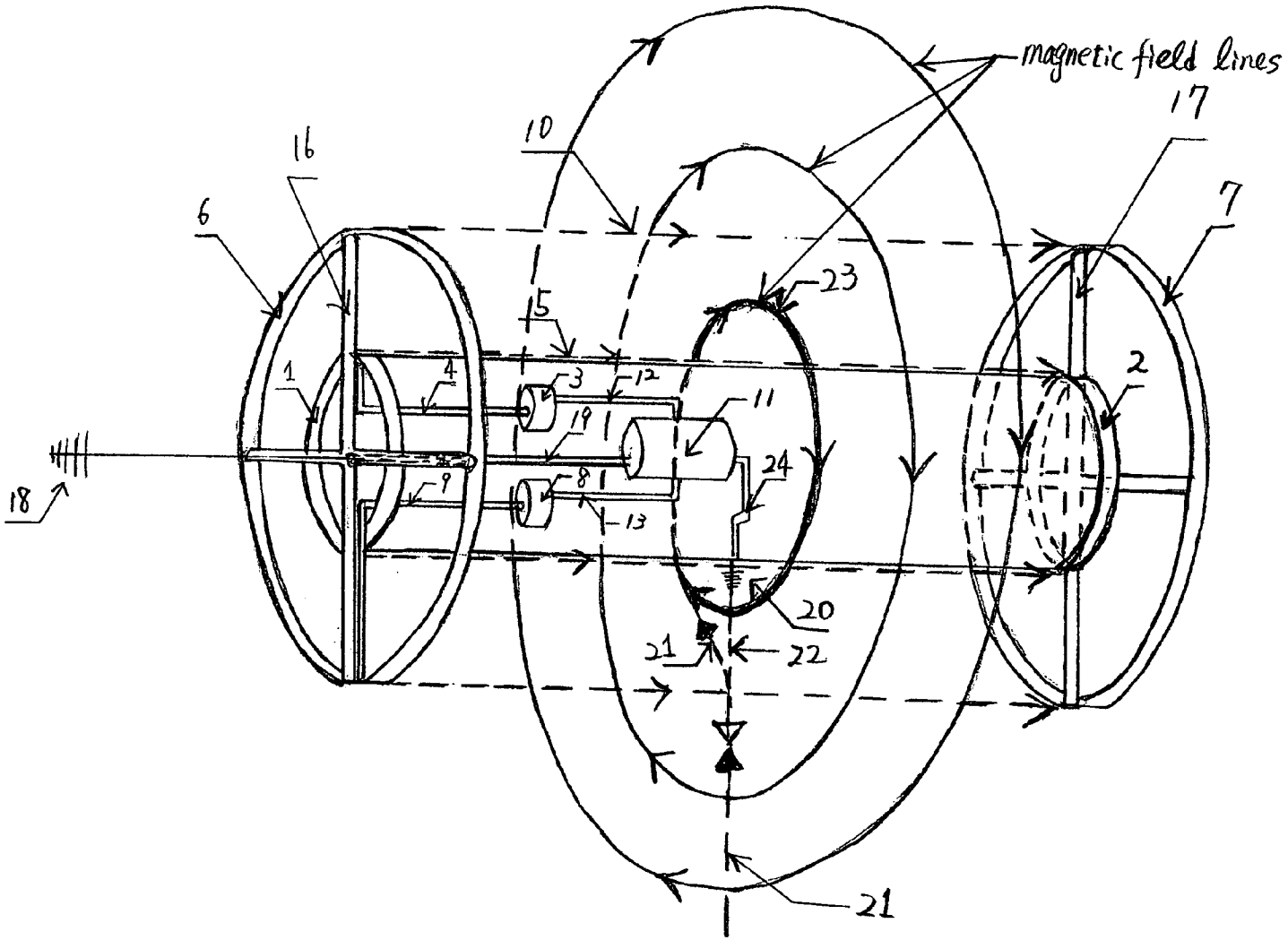
FIG. 4 is a schematic drawing of a mechanism to shield an incoming sound wave launched from SONAR and an incoming magnetosonic wave generated from a nuclear explosion in the pseudo surface microwave produced plasma shielding system.

The plasma shielding system to counter a sound wave, ion acoustic wave, or magnetosonic wave in FIG. 4 basically comprises of the same system components in FIG. 1. These components are the preconditioning surface microwave launcher 1, its receptor 2, the power source 3 for the launcher 1, the power cable 4, the preconditioning surface microwave 5, The primary surface microwave launcher 6, its receptor 7, A power source 8 for the launcher 6, the power cable 9, the primary surface microwave 10, The A.I. 11, the transmission lines 12 and 13, the prominent plasma shielding region 14 with a sharp density gradient and a high maximum plasma density, the support beams 16 for the primary surface microwave launcher 6, the support beams 17 for the receptor 7, the wave detector 18, and the transmission line 19 from the wave detector 18 to the A.I. 11 . The plasma shielding region 14 can have a very high density plasma, i.e., a large current and this results in creating an intense azimuthal magnetic field. In addition to these components, this system has a microwave antenna 20 to produce 180 degree out of phase oscillating electric field in order to cancel the oscillating electric field of the incoming wave. When an ion acoustic wave or magnetosonic wave enters into the plasma shielding system, the wave detector 18 sends information to A.I. 11 through 19. A.I. 11 analyze the wave and sends signals to the microwave antenna 20 to generate 180 degree out of phase oscillating electric field of the incoming wave and to the power source 3 and 8 to create a strong enough magnetic field to confine the incoming wave. Therefore, after the incoming wave enters into the plasma shielding region, it will be confined in the prescribed magnetic field 23 and will not reflect back nor will go inside the object.

The pseudo surface microwave produced plasma shielding system can produce plasmoids. These plasmoids can be further accelerated through a magnetic nozzle. This plasma shielding system can be used as a plasma gun to shoot plasmoids toward a target. It is expected that this plasma gun not only can cause thermodynamic damages to the target, but also can cause electromagnetic damages to the target. The plasma shielding system can be changed to a guided weapon system by developing a magnetic nozzle system created by a surface microwave system and a laser system in a sequential switching manner.

Figure 5:
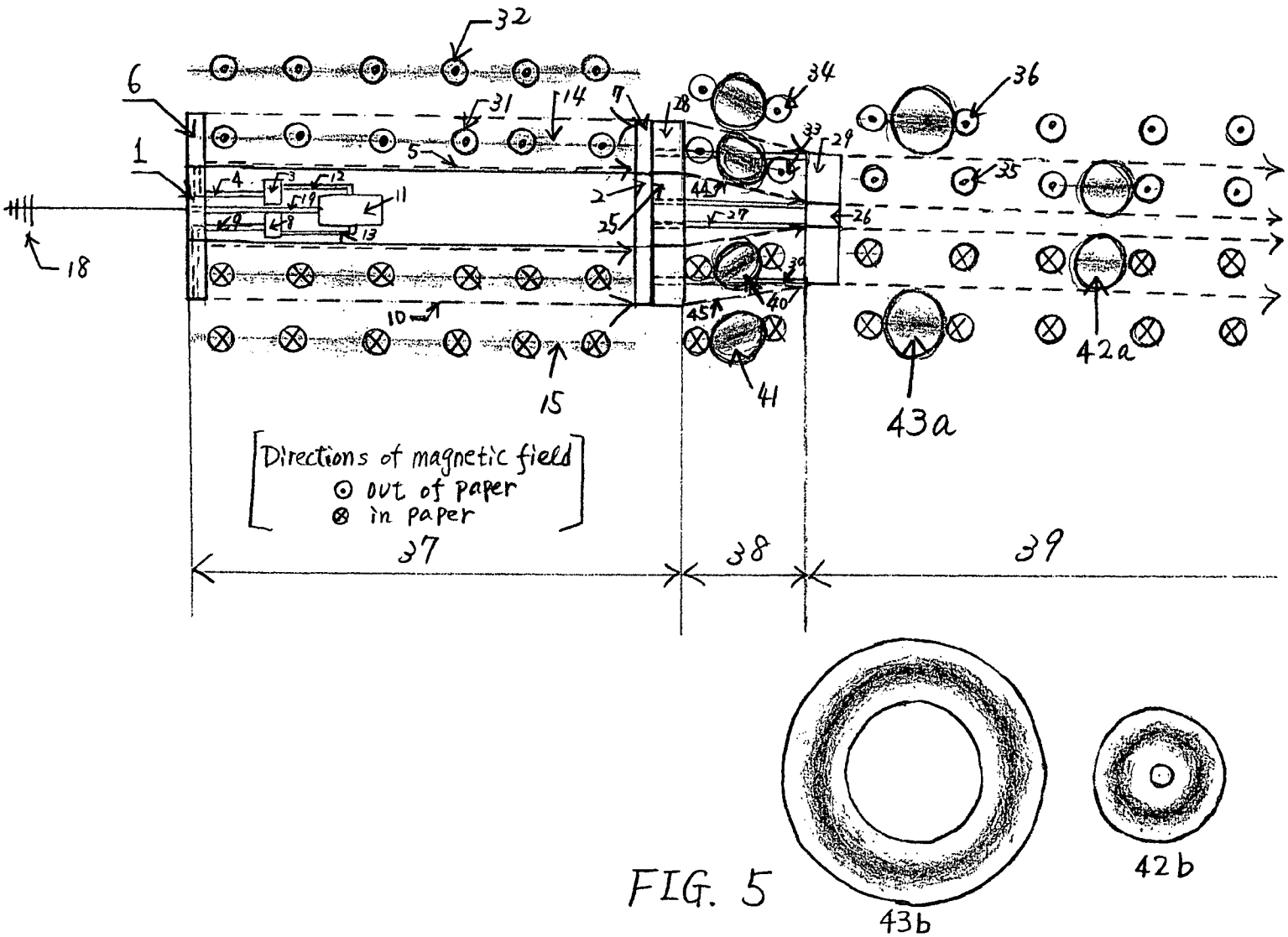
FIG. 5 is a schematic drawing of a mechanism to generate and accelerate plasmoids in the pseudo surface microwave produced plasma shielding system.

FIG. 5 shows a schematic of a plasma gun system extended from the plasma shielding system. This system comprises of the same components in the plasma shielding system depicted in FIG. 1 and the extended components that the plasma shielding system deploys when it functions as the plasma gun system. When the plasma gun system is turned on, the plasma shielding system deploys a sheet laser launcher 25 from the receptor 2 and another sheet laser launcher 28 from the receptor 7. It also deploys a sheet laser refractor 26 which has much smaller diameter than 25 with support beams 27 to create a sheet laser 44 and another sheet laser refractor 29 which has much smaller diameter than 28 with support beams 30 to create a sheet laser 45.

The electric field created by the radial outward plasma particle motions due to the radiation pressure from the surface microwave 5 and the strong magnetic field 31 in the negative azimuthal direction created by the strong current in the plasma region 14 push and accelerate the plasma in the region 37 toward the direction of receptors due to E×B Lorentz force. The plasma in the region 15 is also pushed and accelerated due to the same mechanism of E×B Lorentz force in which the electric field created by the surface microwave 10 and the magnetic field created by the current in the region 15. When the surface microwave systems are turned off and simultaneously the sheet laser systems are turned on, a bulk of plasma coming from the plasma region 14 is compressed and accelerated to form its shape as a plasmoid (a compact torus) 40 in the region 38 due to the same mechanism of E×B Lorentz force and also due to the tapered magnetic nozzle 33 in the region 38. From the same reason, a bulk of plasma coming from the plasma region 15 is also compressed and accelerated to form a larger plasmoid 41 by the tapered magnetic nozzle 34 in the region 38. In the region 39, the conical sheet lasers 44 and 45 are refracted through the refractors 26 and 29 forming cylindrical sheet lasers. In this region, the plasmiod 42*a* formed from 40 and the plasmoid 43*a* formed from 41 are further accelerated to be shot toward a target in the direction where the cylindrical sheet lasers 44 and 45 direct. (The front views of 42*a* and 43*a* are shown in 42*b* and 43*b* respectively) This course of actions can be repeated to continuously fire the plasmoids if necessary. Therefore, this extended plasma shielding system can function as a guided weapon system by changing the direction of the refractor planes.

The use of a plasma flow to control a boundary layer to reduce a drag and noise and to increase a lift was studied in the past. (J. R. Roth, D. M. Sherman, S. P. Wilkinson, "Boundary Layer Flow Control with a One Atmospheric Uniform Glow Discharge Surface Plasma", AIAA 98-0328, 36$^{th}$ Aerospace Sciences Meeting & Exhibit, Jan. 12-15, 1998, Reno, Nev., J. C. Meng, "Wall Layer Microturbulence Phenomenology and a Markov Probability Model for Active Electromagnetic Control of Turbulent Boundary Layers in an Electrically Conducting Medium", A745692, Jun. 1, 1995, S. Leonov, "Plasma Influence on Characteristics of Aerodynamic Friction and Separation Lines Location", A517483, September, 2000) It is expected that the plasma environment in the pseudo surface microwave produced plasma shielding system has a capability to change and control aerodynamic characteristics in a boundary layer around an object. The effects of the plasma flow on alternation of aerodynamic characteristics in a boundary layer were explained in terms of eddy current (vortex) development and suppression in a turbulent flow. (J. R. Roth, D. M. Sherman, S. P. Wilkinson, "Boundary Layer Flow Control with a One Atmospheric Uniform Glow Discharge Surface Plasma", AIAA 98-0328, 36$^{th}$ Aerospace Sciences Meeting & Exhibit, Jan. 12-15, 1998, Reno, Nev.) The relative direction of applied electric field to the direction of the air flow seems to play an important role in determining whether the effects of the plasma is beneficial or detrimental as well as the relative direction of plasma flow to the direction of the air flow. The reduction of a drag (actually the production of a thrust) was reported for the case using a co-flow plasma created by asymmetric spanwise structure of electrodes. (J. R. Roth, D. M. Sherman, S. P. Wilkinson, "Boundary Layer Flow Control with a One Atmospheric Uniform Glow Discharge Surface Plasma", AIAA 98-0328, 36$^{th}$ Aerospace Sciences Meeting & Exhibit, Jan. 12-15, 1998, Reno, Nev.) Although the study by Roth et. al. was to use the planar plasma of electrohydrodynamic characteristics and the effect of magnetic field on the aerodynamic characteristics in the boundary layer was not discussed, it is anticipated to extend this field effect in the boundary layer control method.

In the pseudo surface microwave produced plasma shielding system, if the direction of the surface microwave propagation is in the direction of the air flow, the radiation pressure and the ponderomotive force from the surface wave push energetic plasma particles in the directions of radial outward and of wave propagation. These plasma particles collide with air particles that coming toward the surface of the aircraft and that supposed to deposit detrimental momentum to be a drag force of the aircraft, and change their directions of momentum repelling from the surface of the aircraft as an average. This mechanism also suppresses development of eddy currents that result in creating turbulence. In addition to this phenomenon, the reaction force that the aircraft receives from these plasma particles contributes to a thrust of the aircraft. The pseudo surface microwave produced plasma shielding system was carefully designed to optimize the effective use of plasma particles from the magnetohydrodynamics and plasma physics point of view.

Figure 6:
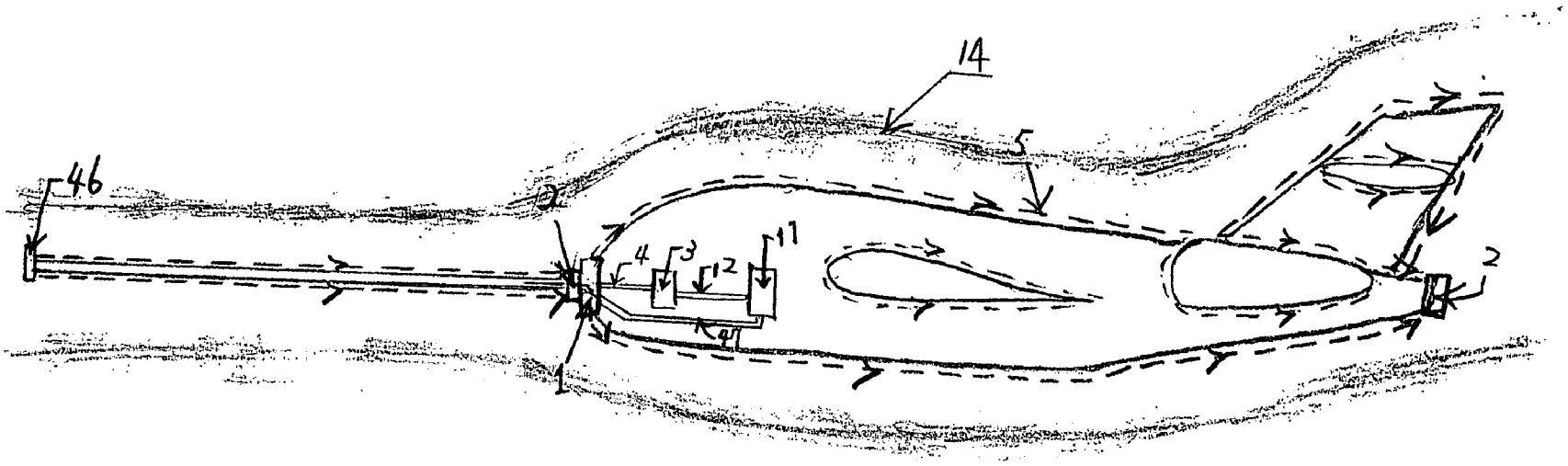
FIG. 6 is a schematic drawing (side view) of a mechanism to control a flow field around an aircraft in the pseudo surface microwave produced plasma shielding system.
Figure 7:
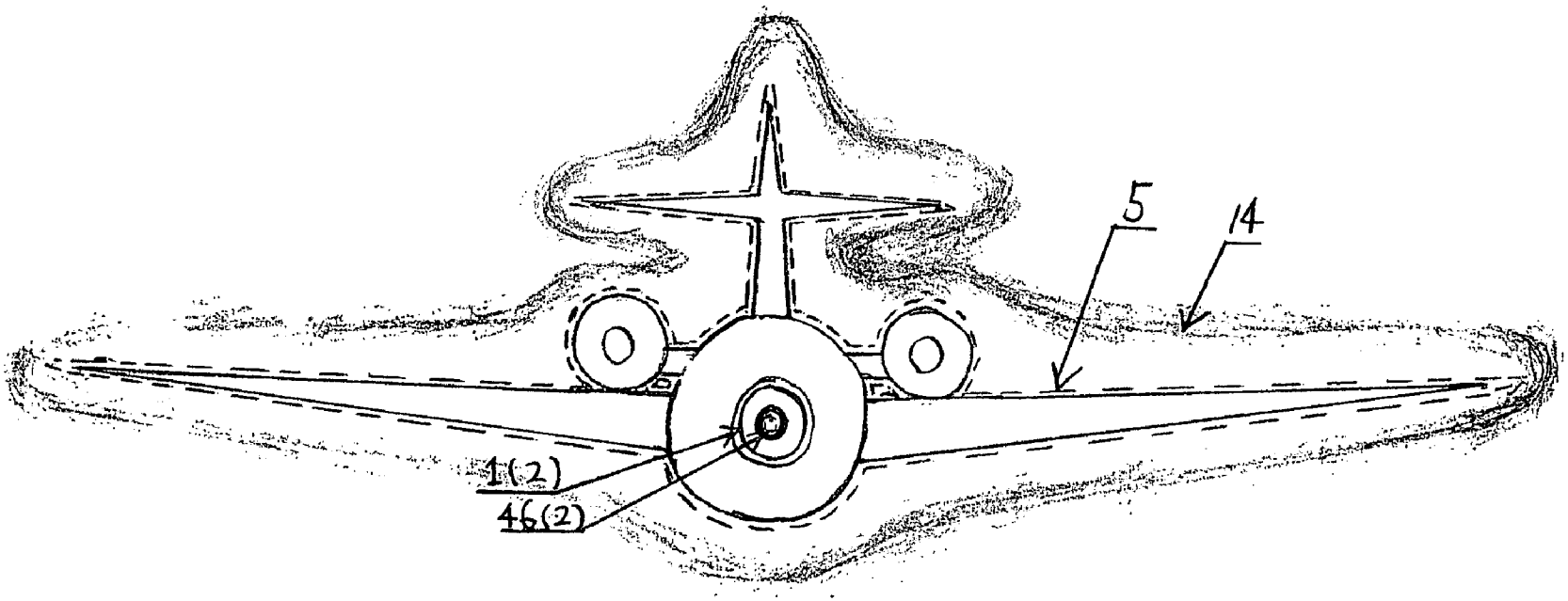
FIG. 7 is a schematic drawing (front view) of a mechanism to control a flow field around an aircraft in the pseudo surface microwave produced plasma shielding system.

FIG. 6 shows a schematic of the plasma shielding system applied to control a flow field around an aircraft. This system basically comprises of the same surface microwave laucher 1—receptor 2 system to launch and propagate a surface microwave 5 at the surface of the aircraft but it does not require the second system to launch and propagate the primary surface microwave if the aircraft does not require to be stealth from RADAR. The same power source 3 as FIG. 1 can be used to operate the launcher or the power can be extracted from the partial engine output. An extended surface microwave launcher rod 46 and its receptor 2 can be mounted on the head of the aircraft in order to produce a plasma region in the upstream region to create a steady state plasma shielding region to cover the entire surface of the aircraft. The amount of drag reduction and turbulence control can be done by sending a signal to the power source 3 by the transmission line 12 and a signal to the launcher 46 by the transmission line 47 from A.I. 11. The front view of FIG. 6 is shown in FIG. 7.

If a surface microwave is launched and propagate in the opposite direction to the air flow along but at about a distance of boundary layer of the airfoil from its surface, the radiation pressure and the ponderomotive force from this surface microwave push plasma particles between the wave and the lower airfoil surface toward the direction of wave propagation and toward the lower surface of the airfoil. These plasma particles collide with high speed incoming air particles that are moving in the direction of air flow, and change their momentum into the direction toward the lower surface of the airfoil as an average. This mechanism increases the upward pressure acting on the lower surface of the airfoil resulting in increase of a lift of the airfoil.

Figure 8:
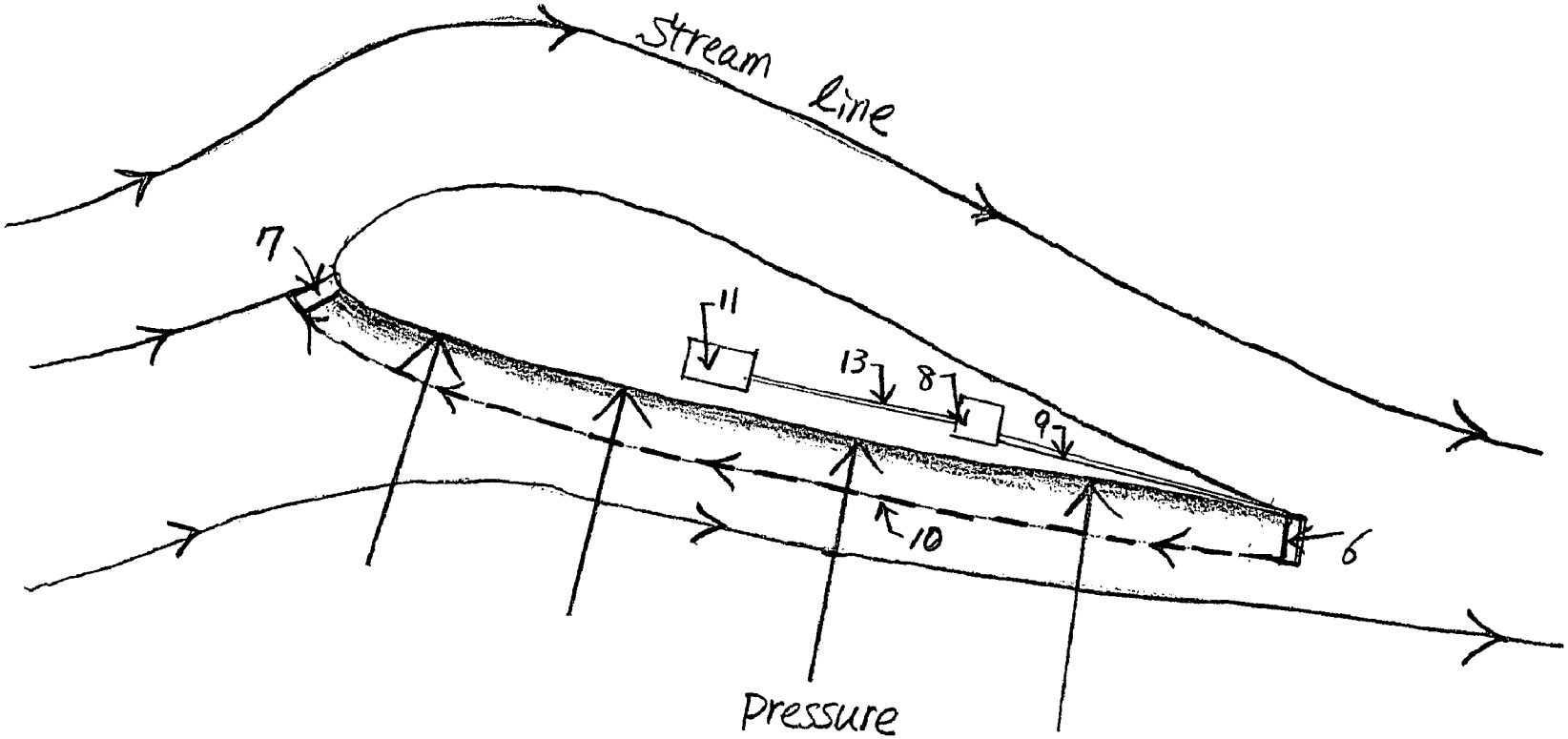
FIG. 8 is a schematic drawing of a mechanism to control a flow field around an airfoil and a lift of an airfoil in the pseudo surface microwave produced plasma shielding system.

FIG. 8 shows a schematic of the plasma shielding system applied to control a flow field around an airfoil. This system basically comprises of the same surface microwave launcher 6-receptor 7 system to launch and propagate a surface microwave 10 in the vicinity of the lower surface of the airfoil boundary layer in the opposite direction to the air flow. In a similar manner to FIG. 6, the power source for this launcher can be same as 8 or extracted from the partial engine output. The amount of lift increase can be controlled by sending a signal to the power source 8 by the transmission line 12 from A.I. 11.

Figure 9:
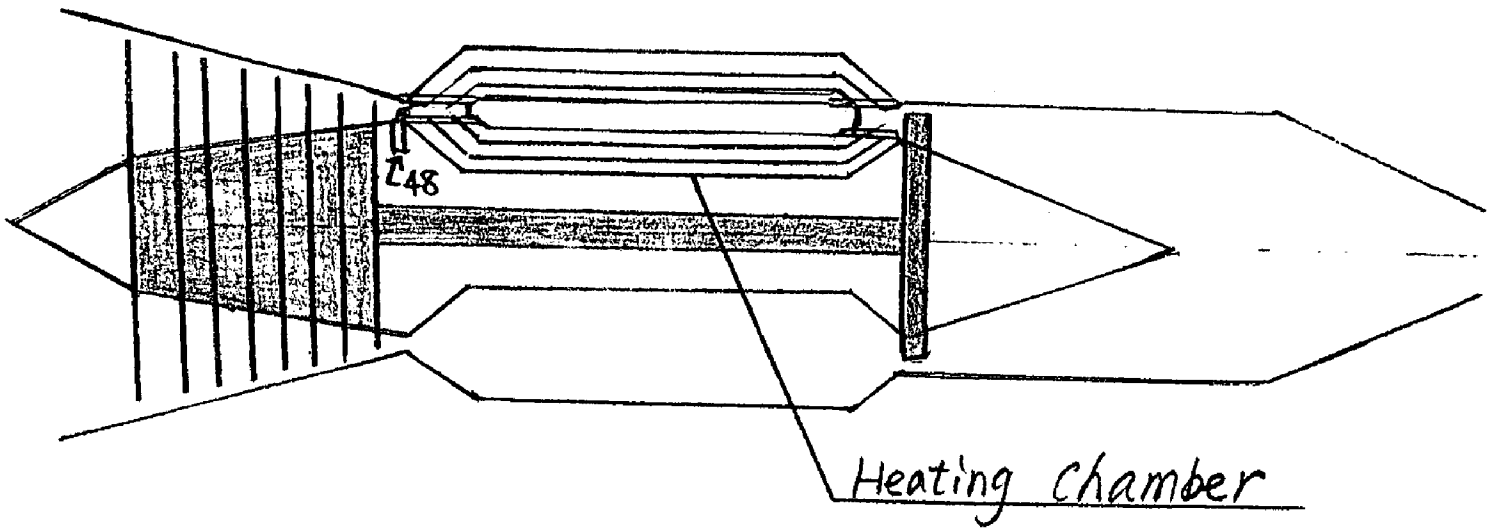
FIG. 9 is a schematic drawing of a concept jet engine with a heating chamber using the pseudo surface microwave produced plasma shielding system.
Figure 10:
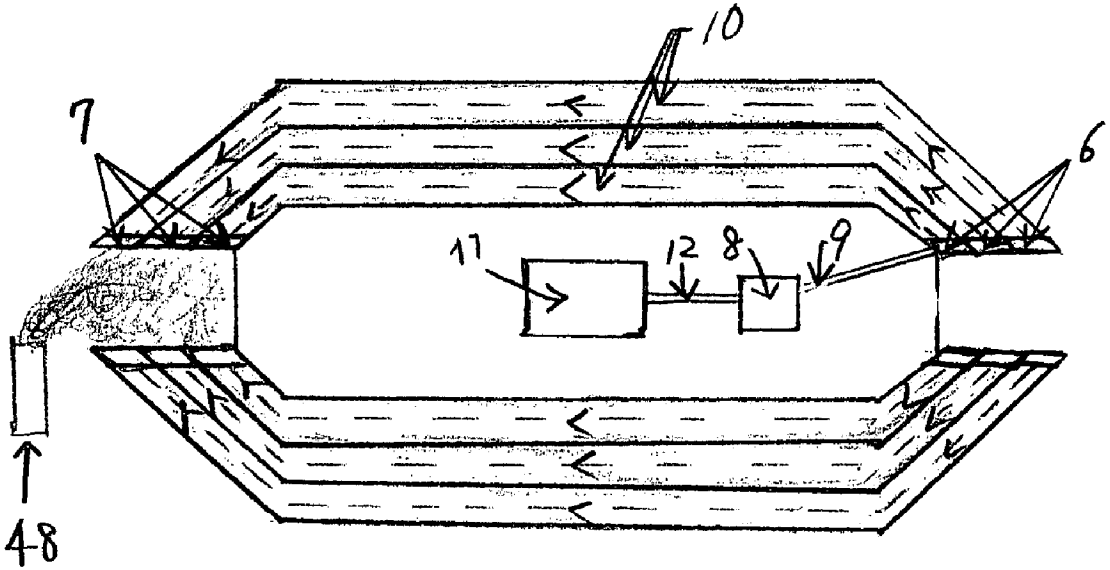
FIG. 10 is a schematic drawing of a heating chamber of a new propulsive device, and a mechanism to heat a propellant and control a thrust level of the engine in the pseudo surface microwave produced plasma shielding system.
Figure 11:
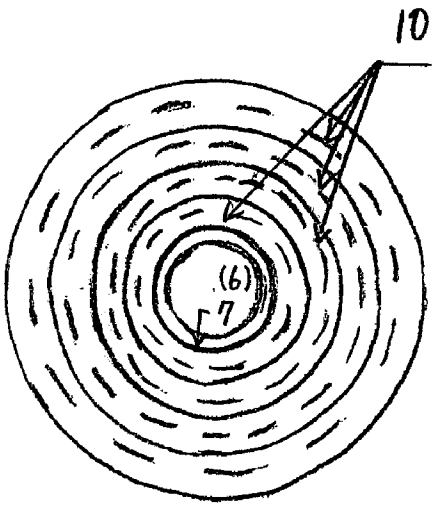
FIG. 11 is a schematic drawing (front view) of a heating chamber of a new propulsive device using the pseudo surface microwave produced plasma shielding system.

The same mechanism of lift increase in the plasma shielding system can be applied to heat a propellant in an engine chamber instead of heating a propellant in the combustion chamber. FIG. 9 shows a schematic of a concept jet engine that does not burn a petroleum-based fuel to obtain a propulsive force. The detailed drawing of the heating chamber is shown in FIG. 10 and the front view of the heating chamber is shown in FIG. 11. In FIG. 10, the engine comprises of a cluster of multi-annular resonant cavity chambers in which surface microwaves 10 propagate through the cavities of the chambers and produce energetic plasma particles to heat air and propellant particles by their collisions. The surface microwave launchers 6 mounted at the exit of each chamber and the receptors 7 mounted at the entrance of each chamber launch and propagate the surface microwave in the opposite direction to the air and propellant flow in each chamber. The energetic plasma particles created from these surface microwaves encounter and collide with the air and propellant particles to increase the internal pressure of the chamber walls. This mechanism results in producing a propulsive force in the engine. The pseudo surface microwave produced plasma shielding system provides effective means of heating a propellant and obtaining a propulsive force. The same power source 8 as FIG. 1 can be used or extracted from the partial engine output. The thrust level can be controlled by A.I. 11.

The invention claimed is:

1. A plasma shielding system comprising:

a device including two sets of a surface microwave launcher ring coupled with a receptor ring, a first one of said sets configured to produce a weakly ionized plasma to precondition the environment thereof and a second set configured to produce a strongly ionized plasma and having a prescribed plasma density gradient;

an electrical power source connected to each of said launchers, for developing an electrical potential therefor; and a computerized control instrument providing analysis of incoming waves and determining appropriate action from pre-calculated data.

2. The system as defined in claim 1 wherein said device comprises a generally cylindrical shape and has at each end thereof an inner ring defining said first one of said sets and an outer ring concentric with said first ring, defining said second set.

3. The system as defined in claim 2 wherein said launchers and receptors of said second set are mounted on support beams.

4. The system as defined in claim 1 wherein said precalculated data is used to generate a plasma density and gradient thereof in order to deflect an incoming wave.

5. The system as defined in claim 4 wherein said precalculated data is based on magnetohydrodynamics, particle-wave interactions, particle-particle interactions and wave-wave interactions.

6. The system as defined in claim 1 wherein said electrical power source comprises a pyroelectric material.

7. The system as defined in claim 6 wherein said material comprises lithium tantalate.

8. The system as defined in claim 1 including a wave detector adapted to detect waves launched from RADAR and said wave detector connected to said computer instrument for analyzing said waves and including means for deflecting or absorbing said waves.

9. The system as defined in claim 1 including a wave detector connected to said computer instrument for analyzing said waves launched from SONAR and including means for capturing said waves from SONAR.

10. The system as defined in claim 9 wherein said antenna is mounted on the device and made mobile in any direction to cancel ion oscillation by generating a 180° out-of-phase electric field for incoming waves.

11. The system as defined in claim 9 including means to prescribe a appropriate magnetic field intensity to counteract incoming waves.

12. The system as defined in claim 1 further including a device comprising a deployable sheet laser launcher from each said receptor and a deployable sheet laser refractor mounted by deployable support beams, second refractor having a smaller diameter in order to create an appropriate magnetic nozzle to compress and form a bulk of plasma into plasmoids.

13. A plasma shield generation system for generating a plasma shield for protecting an object within said plasma shield from a wave detection, said plasma shield generation system comprising:

a first, preconditioning low power microwave plasma generation system further comprising;

a first microwave launcher located at one end of said object, a first microwave receptor located at an opposite end of said object, said first microwave launcher and said first microwave receptor configured for producing a weakly ionized plasma along a surface in order to precondition this regional environment for primary microwaves to propagate, a second, primary higher power microwave plasma generation system further comprising;

a second, higher power microwave launcher configured to launch microwaves of a selected intensity and frequency into said weakly ionized plasma region, generating said plasma shield having selected characteristics related to said selected intensity and frequency of said microwaves, a second microwave receptor configured for receiving said microwaves of a selected intensity and frequency.

14. A plasma shield generation system as set forth in claim 13 wherein said first microwave launcher and said first microwave receptor are of an annular configuration.

15. A plasma shield generation system as set forth in claim 14 wherein said second microwave launcher is of an annular configuration, and externally located coaxial and coplanar with said first microwave launcher, and said second microwave receptor is of an annular configuration, and externally located coaxial and coplanar with said first microwave receptor, said first microwave launcher and said first microwave receptor and said second microwave launcher and said second microwave receptor cooperating to produce an annular said plasma shield, protecting an object within said plasma shield from said wave detection.

16. A plasma shield generation system as set forth in claim 13 wherein said intensity and frequency of said microwaves are determined by characteristics of a received wave from a wave detection system.

17. A plasma shield generation system as set forth in claim 16 wherein said wave detection system is a radar system.

18. A plasma shield generation system as set forth in claim 16 wherein said wave detection system is a sonar system.

19. A plasma shield generation system as set forth in claim 13 wherein said characteristics are selected such that said plasma shield absorbs, captures, or deflects waves from a wave detection system.

* * * * *